US007278178B2

(12) United States Patent
Witzleben

(10) Patent No.: US 7,278,178 B2
(45) Date of Patent: Oct. 9, 2007

(54) TUB FILLER AND OVERFLOW COMBINATION DEVICE

(76) Inventor: Todd Witzleben, 1333 Clifton Street, Winnipeg, Manitoba, R3E 2V1 (CA)

( * ) Notice: Subject to any disclaimer, the term of this patent is extended or adjusted under 35 U.S.C. 154(b) by 346 days.

(21) Appl. No.: 10/959,065

(22) Filed: Oct. 7, 2004

(65) Prior Publication Data

US 2006/0075549 A1 Apr. 13, 2006

(30) Foreign Application Priority Data

Aug. 24, 2004 (CA) ..... 2479043

(51) Int. Cl.
*E03C 1/00* (2006.01)

(52) U.S. Cl. ..... 4/674; 4/671; 4/678

(58) Field of Classification Search ..... 4/671, 4/673, 674, 675, 678
See application file for complete search history.

(56) References Cited

U.S. PATENT DOCUMENTS 1,010,469 A * 12/1911 Weaver ..... 4/671
1,562,980 A * 11/1925 Muend ..... 4/674 X
1,994,789 A * 3/1935 Redmond et al. ..... 4/674 X
3,602,244 A * 8/1971 Ward ..... 4/678 X
5,148,828 A 9/1992 Farnham ..... 137/454.6
5,207,242 A 5/1993 Daghe et al. ..... 137/454.6
5,832,958 A 11/1998 Cheng ..... 137/625.41
5,862,829 A 1/1999 Sand ..... 137/216
6,098,651 A 8/2000 Boticki et al. ..... 137/216
6,220,282 B1 4/2001 Powell ..... 137/512
6,292,958 B1 * 9/2001 Benne et al. ..... 4/674
6,363,549 B2 4/2002 Humpert et al. ..... 4/623
6,381,770 B1 5/2002 Raisch ..... 4/570
6,581,626 B2 6/2003 Noll et al. ..... 137/315.11
6,823,539 B1 * 11/2004 Bantz ..... 4/675

* cited by examiner

*Primary Examiner*—Robert M. Fetsuga
(74) *Attorney, Agent, or Firm*—Ryan W. Dupuis; Michael R. Williams; Adrian D. Battison

(57) ABSTRACT

A tub filler and overflow combination device is supported within a common opening formed in a tub wall. Both a flow passage and a drain passage extend through the body of the device to communicate through the common opening in the tub wall. A backflow preventer of the flow passage is slidably removable through the flow outlet for readily servicing the components of the backflow preventer as desired. The flow inlet is parallel and opposite to the flow outlet for ease of manufacturing and for ease of installation into a bathtub.

20 Claims, 4 Drawing Sheets

TUB FILLER AND OVERFLOW COMBINATION DEVICE

This application claims foreign priority benefits from Canadian Patent Application 2,479,043, filed Aug. 24, 2004.

FIELD OF THE INVENTION

The present invention relates to a tub filler and overflow combination device for being supported within an opening formed in a tub wall of a bath tub for both filling the bath tub and providing an overflow drain to the bath tub through a common opening in the tub wall.

BACKGROUND

Bath tubs and other similar types of basins typically have hot water and cold water supply lines with either separate valves or a common valve provided for controlling flow of hot and cold water to a mixed outlet feeding a tub filler line. Bathtub spouts are then commonly mounted on the tub filler line. A separate drain waste and over flow system is typically provided having a drain at a bottom of the basin with a branch line extending upwardly to an over flow connection communicating through an opening in the tub wall spaced upwardly from the bottom of the tub. The overflow remains open to also act as a vent for the drain line. In general it is aesthetically unappealing to have both a spout and a separate overflow spaced apart along the tub wall. Furthermore installation requires unnecessary effort in forming two separate holes in the wall for plumbing the two components separately.

One known device is manufactured by Geberit Manufacturing Inc. of Michigan City, Ind., as described at http://www.us.geberit.com. The device provides a tub filler and an overflow within a common housing. To prevent back flow, a check valve is connected in series with the flow into the device in combination with a required vacuum breaker upstream and in series with the flow into the device, at higher elevation than the flood level of the tub, that is a top edge of the tub. The flow inlet of the tub filler is provided at a side of the device, perpendicular to the flow outlet into the tub, requiring extra elbow connectors and installation time as compared to a conventional spout. As the backflow prevention components of the check valve and vacuum breaker are required to be upstream from the device servicing would require messy and time consuming removal of components from the plumbing line buried within the wall.

SUMMARY

According to one aspect of the present invention there is provided a filler and overflow combination device for being supported within an opening formed in a tub wall, the device comprising:

a body having first and second portions;

mounting means for supporting the body to extend through an opening in a tub wall from the first portion of the body to the second portion of the body on opposing sides of the tub wall;

a flow passage extending through the body from a flow inlet at the first portion to a flow outlet at the second portion;

a drain passage extending through the body from a drain inlet at the second portion to a drain outlet at the first portion; and a backflow prevention device supported in series with the flow passage, the backflow prevention device being slidably removable from the body through the flow outlet.

The flow outlet and the drain inlet may be concentric with one another at the second portion of the body. Preferably, the flow inlet is parallel to the flow outlet such that the flow inlet and flow outlet are formed in opposing sides of the body.

By providing a backflow prevention device which is slidably removable through the flow outlet, the backflow prevention device can be readily serviced with minimal disassembly of the device and no destruction of the wall or plumbing line being required. By providing an inline connection of the flow inlet at the rear parallel and opposite from the flow outlet at the front, the device is readily manufactured and can be installed easily in a manner similar to conventional spouts.

The backflow prevention device may comprise a pair of check valves supported in series with one another. There may be provided a releasable retainer member retaining the backflow prevention device within the flow outlet.

According to a second aspect of the present invention there is provided a filler and overflow combination device for being supported within an opening formed in a tub wall, the device comprising:

a body having first and second portions;

mounting means for supporting the body to extend through an opening in a tub wall from the first portion of the body to the second portion of the body on opposing sides of the tub wall;

a flow passage extending through the body from a flow inlet at the first portion to a flow outlet at the second portion; and a drain passage extending through the body from a drain inlet at the second portion to a drain outlet at the first portion;

the flow outlet and the drain intlet being concentric with one another at the second portion of the body; and the flow inlet being parallel to the flow outlet such that the flow inlet and flow outlet are formed in opposing sides of the body.

There may be provided a cap member selectively mounted on the second portion of the body concealing the flow outlet and the drain inlet.

The cap member may include first and second chambers formed within an exterior body for communication with the flow outlet and the drain inlet respectively wherein each of the first and second chambers communication through the exterior body of the cap member by respective apertures formed therein.

The apertures in the exterior body are preferably all formed in a bottom side of the cap member.

The flow outlet may be connected with the first chamber by a suitable sealing member preventing direct flow from the flow outlet to the drain inlet within the cap member.

The cap member may be selectively mounted on the second portion of the body by a set screw for ready removal when replacing the components of the backflow prevention device.

BRIEF DESCRIPTION OF THE DRAWINGS

In the accompanying drawings, which illustrate an exemplary embodiment of the present invention.

DETAILED DESCRIPTION

Figure 1:
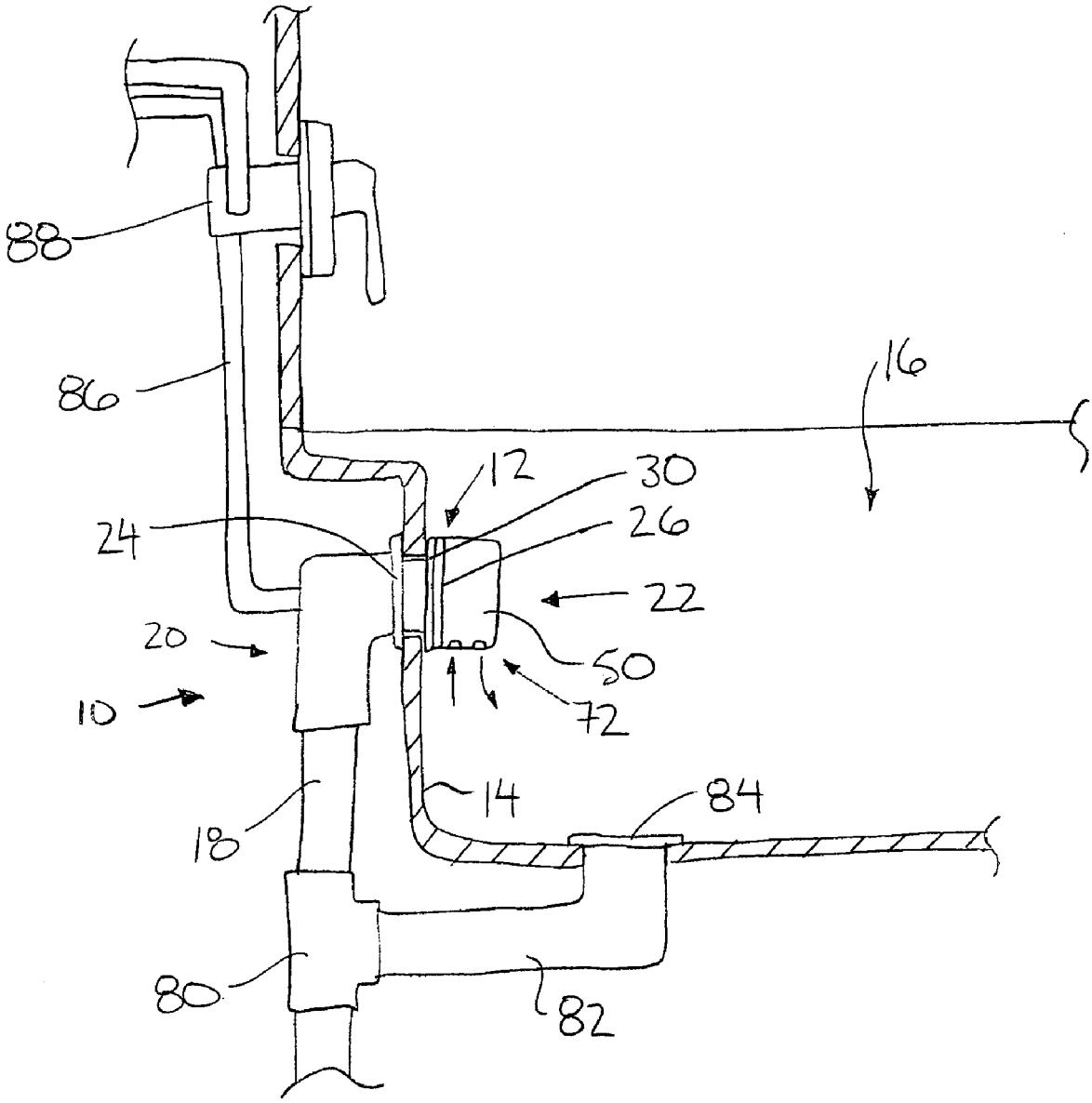
FIG. 1 is schematic view of the device as installed in a bathtub.
Figure 2:
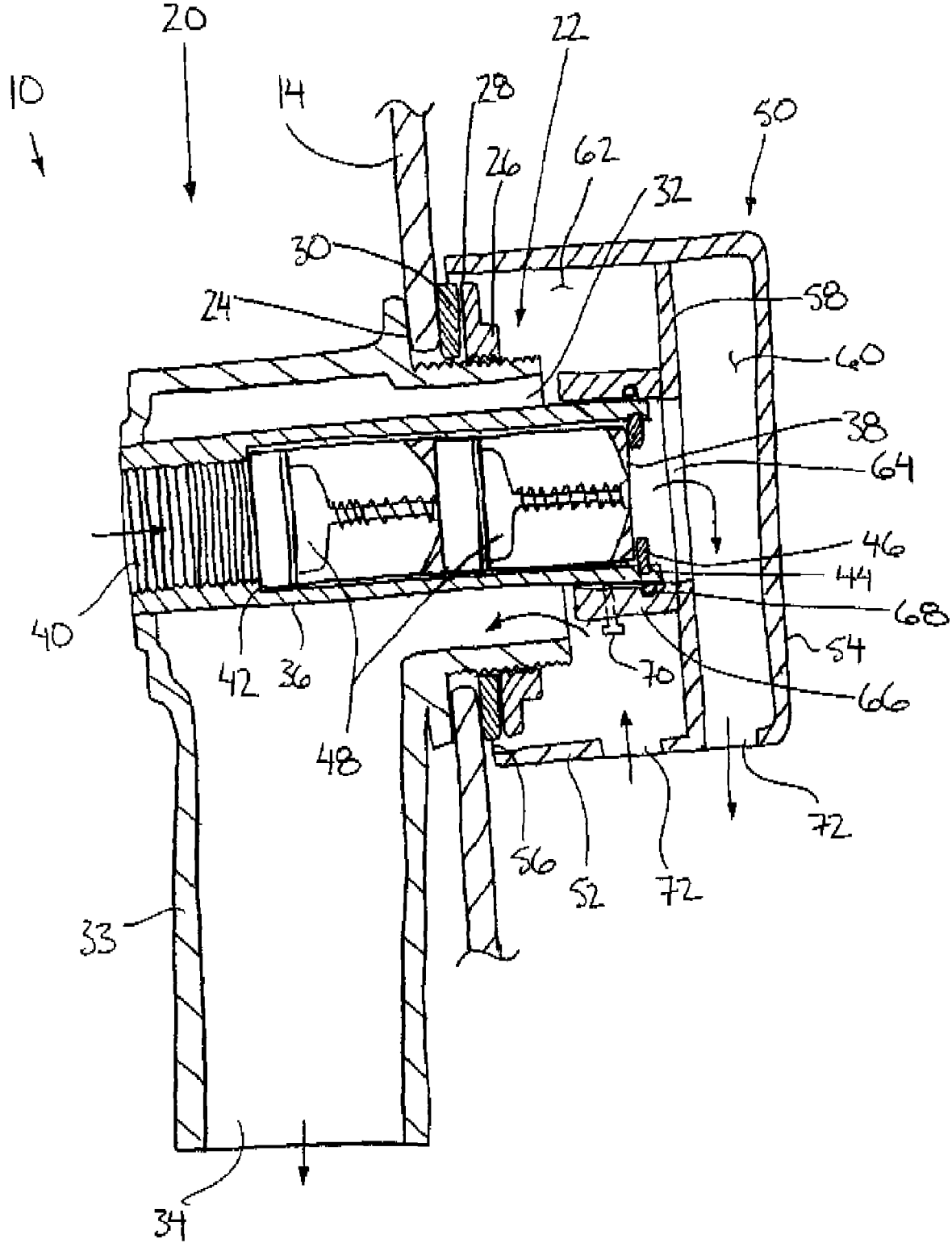
FIG. 2 is a partly sectional side elevational view of the device.
Figure 3:
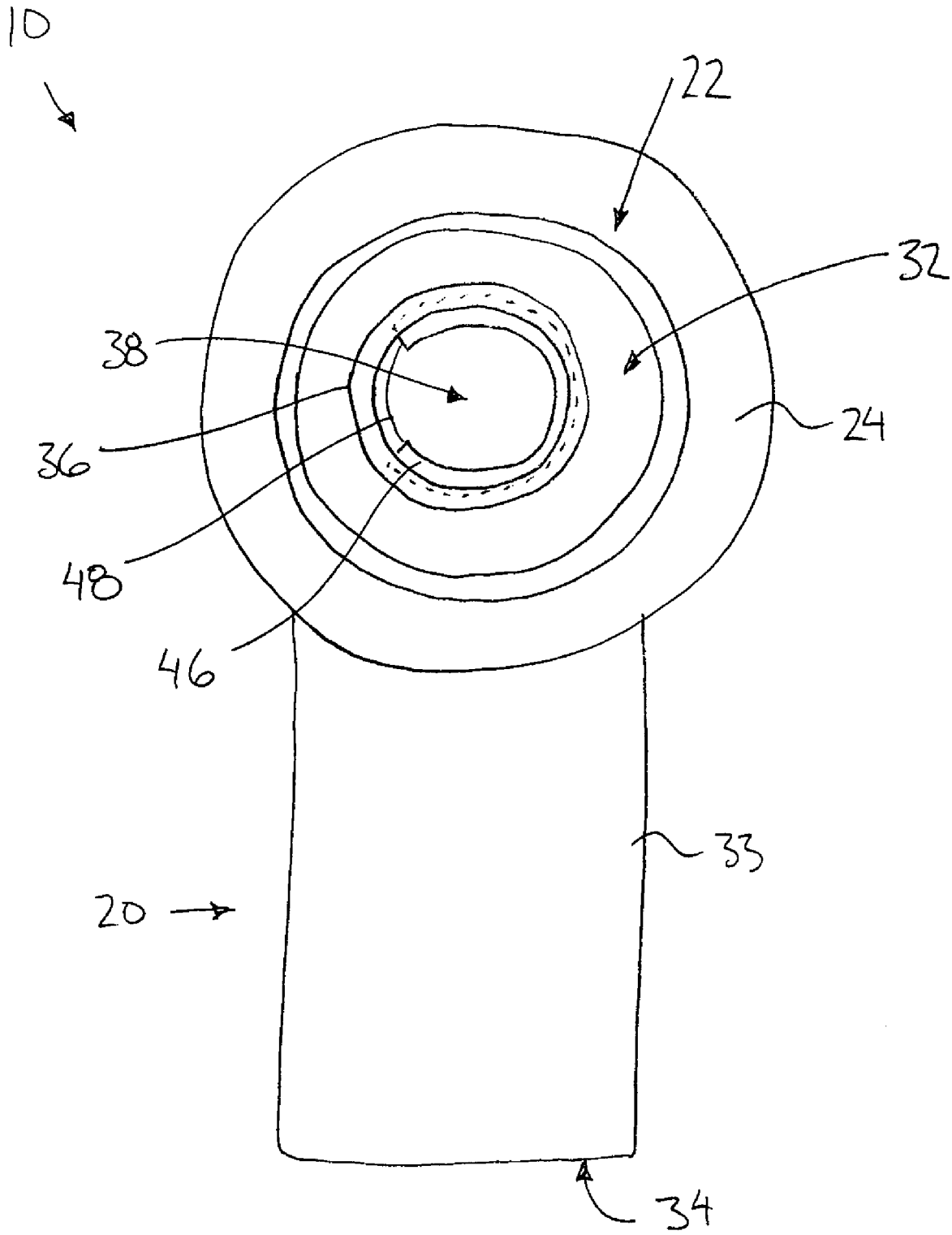
FIG. 3 is a front elevational view of the device.
Figure 4:
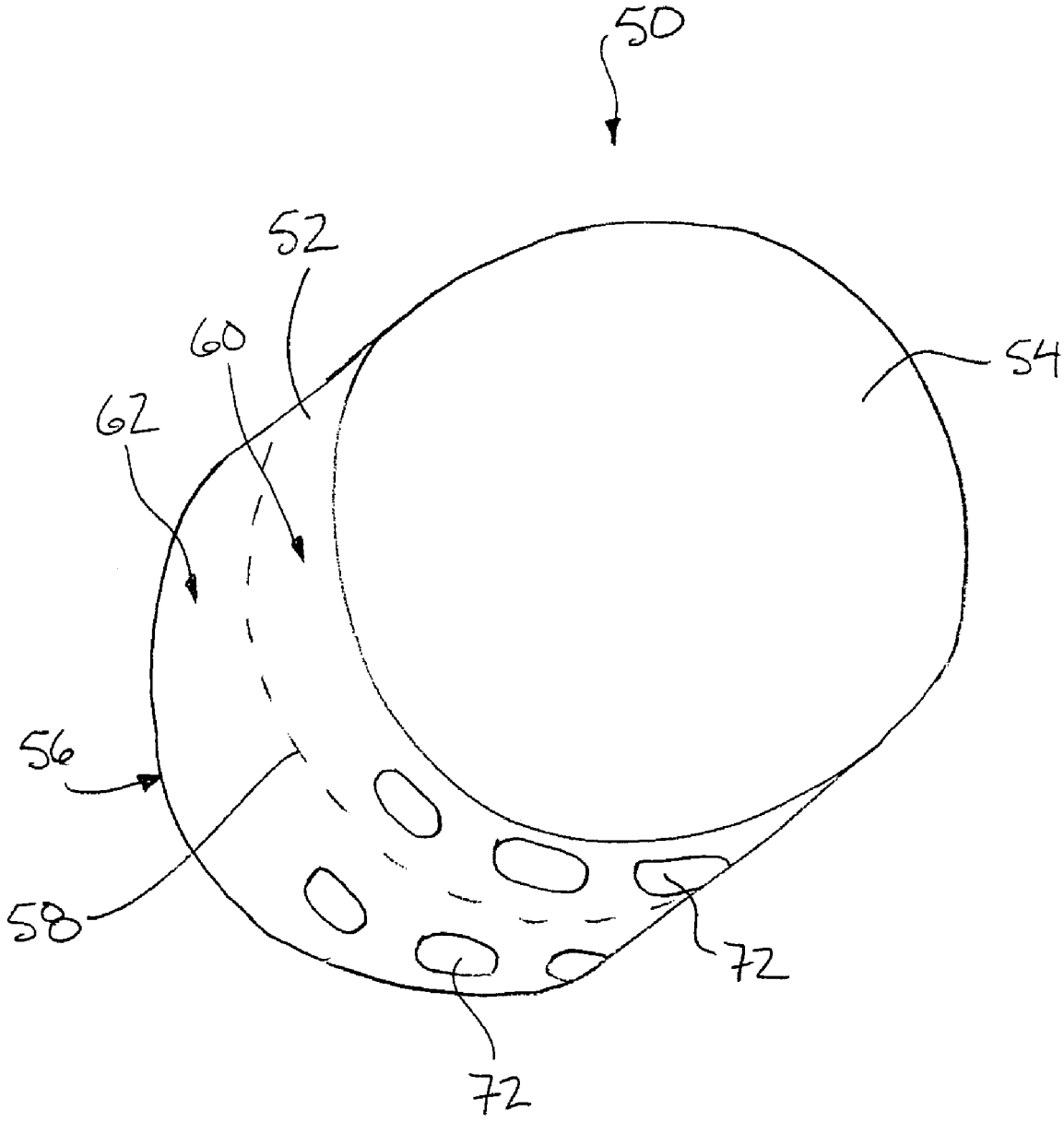
FIG. 4 is a perspective view of the cap member showing the bottom side thereof.

Referring to the accompanying drawings, there is illustrated a tub filler and overflow combination device generally indicated by reference numeral 10. The device 10 is suitable for being supported within an opening 12 formed in a tub wall 14 of a bathtub 16 for both filling the bathtub and providing an overflow drain 18 to the bathtub through the common opening 12 in the tub wall.

The device 10 includes a body having a first portion 20 to be mounted externally of the tub wall, and a second portion 22 projecting through the opening in the tub to be located internally within the tub in the mounted position. The first portion 20 includes an annular mounting face 24 extending about the body at the junction of the first and second portion so as to be oriented to face towards the second portion of the body. When the second portion extends through the opening in the tub, the annular mounting face 24 is arranged to overlap about a full periphery of the opening in the tub wall at the exterior side thereof.

The second portion 22 comprises a cylindrical threaded collar concentric with the annular mounting face 24 projecting coaxially therewith through the opening and beyond the tub wall into the interior of the bathtub. A mount includes a threaded mounting ring 26 which mounts about the threaded collar defining a second potion 22 and similarly includes an annular mounting face 28 which confronts the face 24 of the first portion far clamping the tub wall there between about the periphery of the opening. A suitable sealing ring 30 or sealing member of resilient material is supported between the mounting face 28 of the ring and the tub wall so that he mounting face 28 engages the sealing ring about the full periphery of the opening in the tub wall.

The collar defining the second portion 22 includes a hollow interior forming a drain inlet 32 at the second potion which communicates with a sleeve 33 forming a part of the first portion of the body. The sleeve is also hollow and defines a drain outlet 34 at an open bottom end thereof. The sleeve and the collar are substantially perpendicular with one another with the axis of the sleeve lying approximately at 93 degrees to the axis of the collar defining the second portion so that the drain outlet and the flow outlet are offset from perpendicular with one another within a range of 1 to 5 degrees. The collar and sleeve are enclosed at the point of communication with one another to define an enclosed drain passage extending from the opening at the drain inlet 32 of the collar to the opening in the sleeve defining the drain outlet 34.

The body also includes a flow passage formed therein in the form of a tube 36 extending concentrically through the threaded collar defining the second portion. A flow outlet 38 of the flow passage extends coaxially through and beyond the collar defining the second portion although being smaller in diameter so as to define an annular space between the tube 36 and the surrounding collar which comprises the drain inlet. The flow inlet lies coaxially, so as to be parallel and concentric, with the flow outlet to extend through the opposing side of the body so that the flow inlet 40 projects through a rear face of the body at the first portion thereof.

The flow inlet is internally threaded for receiving a standard plumbing fitting therein. The threaded portion of the flow inlet 40 terminates at an internal shoulder where the flow passage increases in diameter for the remainder thereof towards the flow outlet. The diameter is suitable for slidably receiving a pair of check valves in series through the open end of the flow outlet 38 for abutment against the internal shoulder 42 of the flow passage.

An internal; annular groove 44 is formed adjacent the open end of the flow outlet for receiving a C-shaped retainer clip 46 therein which selectively retains the pair of check valves 48 within the flow passage.

Each of the check valves 48 is a self contained unit including a cylindrical housing, a valve head, a valve seat and biasing means for biasing the valve towards the closed position. The check valve only permits flow in one direction therethrough.

The check valves are supported within the flow passage so that both are oriented to only allow flow from the flow inlet to the flow outlet through the flow passage. In this configuration the two check valves 48 together form a back flow preventer or backflow prevention device in series with the flow passage.

A cap member 50 is provided to cover and conceal the flow outlet and drain inlet at the second portion of the body. The cap member includes a cylindrical body 52 having a hollow interior which is capped at an outer end 54 while remaining open at an opposing inner end 56. A divider wall 58 spans the hollow interior to divide the cap member into a first chamber 60 adjacent the outer end 54 and a second chamber 62 adjacent the open inner end 56.

A central aperture 64 in the divider wall 58 includes an integral mounting collar 66 supported thereon for receiving the end of the tube defining the flow outlet which projects beyond the collar forming the drain inlet 32. An integral groove 68 formed within the collar 66 receives an O-ring therein for sealing between the flow outlet and the first chamber. The O-ring prevents any direct flow of fluid from the flow outlet and first chamber to the second chamber or the drain inlet within the interior of the cap member 50. A set screw 70 holds the mounting collar 66 firmly in place in relation to the tube defining the flow outlet.

A plurality of spaced apart apertures 72 are provided in only the bottom portion of the cylindrical body 52 in communication with both the first and second chambers respectively. Flow from the flow outlet into the first chamber is thus even disbursed through the apertures 72 in the bottom of the chamber for dispensing into the bath tub. Similarly, rising water in the bathtub rises up through the bottom apertures in the second chamber for communication with the annular shaped drain inlet in communication through the open end of the cap member 50. The backflow preventer formed by the check valves in series prevents the rising water from entering into the potable water supply fed to the flow passage.

The device 10 is installed within the opening 12 formed in a tub wall 14 typically for use with a conventional overflow device. The sleeve projecting downwardly from the device forming the drain outlet connects to a conventional plumbing tee 80 coupled to a drain line 82 of a drain 84 in the bottom of the bathtub. The tub filler line 86 coming from the mixer 88 of the hot and cold water supply lines is then connected to the rear face of the device at the flow inlet similar to connection to a conventional spout.

Periodically when the check valve forming the back flow prevention device requires servicing, the cap member is simply removed by loosening the set screw in the mounting collar thereof and the retainer clip at the flow outlet is then removed so that the check valves can be slidably removed through the flow outlet and replaced as desired.

While one embodiment of the present invention has been described in the foregoing, it is to be understood that other embodiments are possible within the scope of the invention. The invention is to be considered limited solely by the scope of the appended claims.

The invention claimed is:

1. A filler and overflow combination device for being supported within an opening formed in a tub wall, the device comprising:

a body having first and second portions;

a mount arranged for supporting the body to extend through an opening in a tub wall from the first portion of the body to the second portion of the body on opposing sides of the tub wall;

a flow passage comprising a tube extending through the body from a flow inlet at the first portion to a flow outlet at the second portion;

a drain passage extending through the body from a drain inlet at the second portion to a drain outlet at the first portion;

a backflow prevention device arranged for preventing backflow and being supported slidably in series within the tube of the flow passage;

the backflow prevention device being slidably removable from the tube of the flow passage of the body through the flow outlet; and a cap member selectively mounted on the second portion of the body concealing the flow outlet and the drain inlet;

the cap member being selectively mounted on the second portion of the body by a set screw.

2. The device according to claim 1 wherein the flow outlet and the drain inlet are concentric with one another at the second portion of the body and the flow inlet is parallel to the flow outlet such that the flow inlet and flow outlet are formed in opposing sides of the body.

3. The device according to claim 1 wherein the backflow prevention device comprises a pair of check valves supported in series with one another.

4. The device according to claim 1 wherein there is provided a releasable retainer member retaining the backflow prevention device within the flow outlet.

5. The device according to claim 1 wherein the cap member includes first and second chambers formed within an exterior body for communication with the flow outlet and the drain inlet respectively, each of the first and second chambers communication through the exterior body of the cap member by respective apertures formed therein.

6. The device according to claim 5 wherein the apertures in the exterior body are all formed in a bottom side of the cap member.

7. The device according to claim 5 wherein the flow outlet is connected with the first chamber by a suitable sealing member preventing direct flow from the flow outlet to the drain inlet within the cap member.

8. The device according to claim 1 wherein the flow outlet and the drain outlet are offset from perpendicular with one another within a range of 1 to 5 degrees.

9. The device according to claim 1 wherein there is provided a shoulder formed in the tube of the flow passage against which the backflow prevention device is abutted.

10. The device according to claim 1 wherein there is provided an annular groove in the flow passage adjacent the flow outlet and a C-shaped retainer clip in the annular groove arranged to selectively retain the backflow prevention device within the flow passage.

11. A filler and overflow combination device for being supported within an opening formed in a tub wall, the device comprising:

a body having first and second portions;

a mount arranged for supporting the body to extend through an opening in a tub wall from the first portion of the body to the second portion of the body on opposing sides of the tub wall;

a flow passage extending through the body from a flow inlet at the first portion to a flow outlet at the second portion;

a drain passage extending through the body from a drain inlet at the second portion to a drain outlet at the first portion; and a backflow prevention device supported in series with the flow passage;

the backflow prevention device being slidably removable from the body through the flow outlet; and the backflow prevention device comprising a pair of check valves supported in series with one another.

12. The device according to claim 11 wherein:

the flow outlet and the drain inlet are concentric with one another at the second portion of the body; and the flow inlet comprises an internally threaded portion of the flow passage which is arranged for connection to a standard plumbing fitting and which is parallel to the flow outlet such that the flow inlet and flow outlet are formed in opposing sides of the body.

13. The device according to claim 12 wherein there is provided a cap member selectively mounted on the second portion of the body concealing the flow outlet and the drain inlet.

14. The device according to claim 13 wherein the cap member includes first and second chambers formed within an exterior body for communication with the flow outlet and the drain inlet respectively, each of the first and second chambers communication through the exterior body of the cap member by respective apertures formed therein.

15. The device according to claim 14 wherein the apertures in the exterior body are all formed in a bottom side of the cap member.

16. The device according to claim 14 wherein the flow outlet is connected with the first chamber by a suitable sealing member preventing direct flow from the flow outlet to the drain inlet within the cap member.

17. The device according to claim 13 wherein the cap member is selectively mounted on the second portion of the body by a set screw.

18. The device according to claim 12 wherein the flow outlet and the drain outlet are offset from perpendicular with one another within a range of 1 to 5 degrees.

19. The device according to claim 11 wherein there is provided a shoulder formed in the tube of the flow passage against which the backflow prevention device is abutted.

20. The device according to claim 11 wherein there is provided an annular groove in the flow passage adjacent the flow outlet and a C-shaped retainer clip in the annular groove arranged to selectively retain the backflow prevention device within the flow passage.

* * * * *